United States Patent [19]

Beer et al.

[11] 4,338,698

[45] Jul. 13, 1982

[54] VEHICLE CLEANING BRUSH HAVING LIMITED PENETRATION

[75] Inventors: Carl C. Beer, Philadelphia, Pa.; Robert A. Seng, Waterford, N.J.

[73] Assignee: Sherman Industries, Inc., Palmyra, N.J.

[21] Appl. No.: 157,593

[22] Filed: Jun. 9, 1980

[51] Int. Cl.[3] ..... A46B 7/10; B60S 3/06

[52] U.S. Cl. ..... 15/230.16; 15/DIG. 2; 15/DIG. 5; 15/183

[58] Field of Search ..... 15/DIG. 2, DIG. 5, DIG. 6, 15/97 R, 97 B, 179, 180, 181, 182, 183, 114, 53 A, 53 AB, 53 B, 230.15, 230.16; 51/334, 335, 336, 337

[56] References Cited

U.S. PATENT DOCUMENTS

| | | | |
|---|---|---|---|
| 1,515,275 | 11/1924 | Pringle . | |
| 1,611,525 | 12/1926 | Hendrickson . | |
| 1,856,289 | 5/1932 | Owens | 15/181 |
| 2,641,786 | 6/1953 | Parker . | |
| 2,704,854 | 3/1955 | Peterson . | |
| 2,978,726 | 4/1961 | Park | 15/183 |
| 3,139,641 | 7/1964 | Grogan et al. | 15/182 |
| 3,393,418 | 7/1968 | Mundo | 15/179 X |
| 3,594,842 | 7/1971 | Clark | 15/DIG. 2 |
| 3,761,986 | 10/1973 | Rickel | 15/53 AB |
| 3,914,908 | 10/1975 | Belanger | 51/334 |
| 3,986,223 | 10/1976 | Kiefer | 15/1.5 R |
| 4,104,756 | 8/1978 | Gasser et al. | 15/230.16 |

*Primary Examiner*—Peter Feldman

*Attorney, Agent, or Firm*—Seidel, Gonda, Goldhammer & Panitch

[57] ABSTRACT

A rotatable cloth scrubbing rush for cleaning the exterior of a vehicle comprises a rotatable shaft or hub, a plurality of cloth wiping members for contacting the surface to be cleaned, and means for limiting the penetration of the portion of the vehicle being cleaned with the brush. One such means for limiting penetration of the portion of the vehicle being cleaned comprises a disk wheel of a predetermined diameter mounted around said shaft or hub and interposed between said cloth wiping members. Another means for limiting penetration comprises sets of bristles connected at one end to said shaft or hub and interleaved between rows of cloth wiping members.

3 Claims, 7 Drawing Figures

FIG. 1
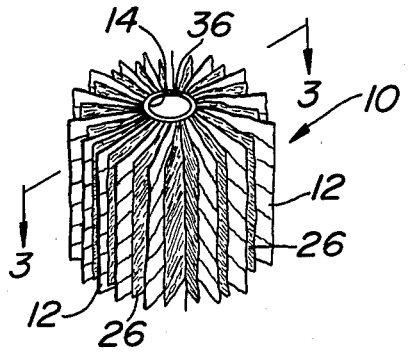
FIG. 2
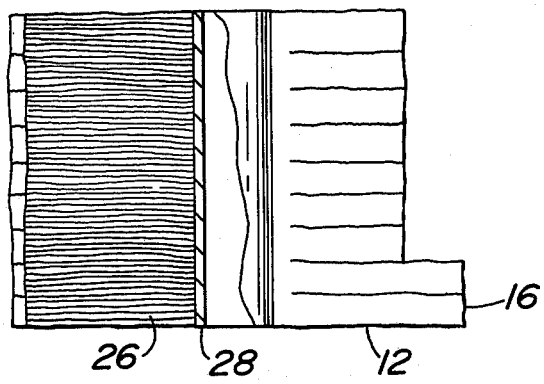
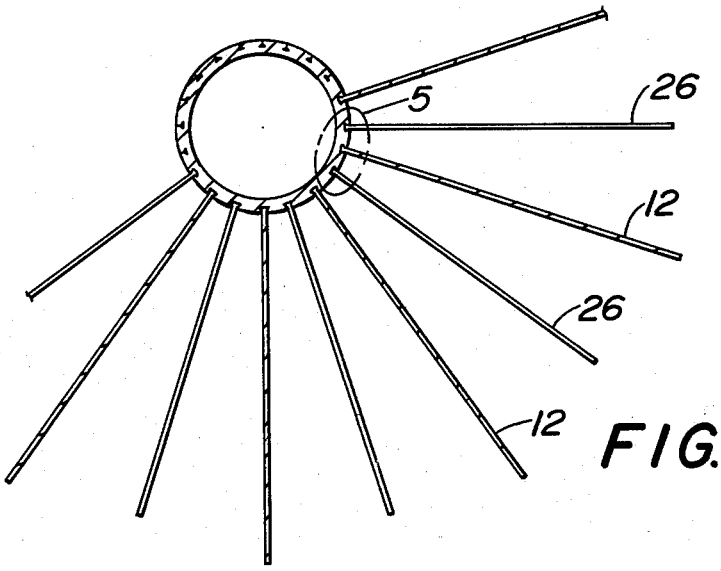
FIG. 3

FIG. 4
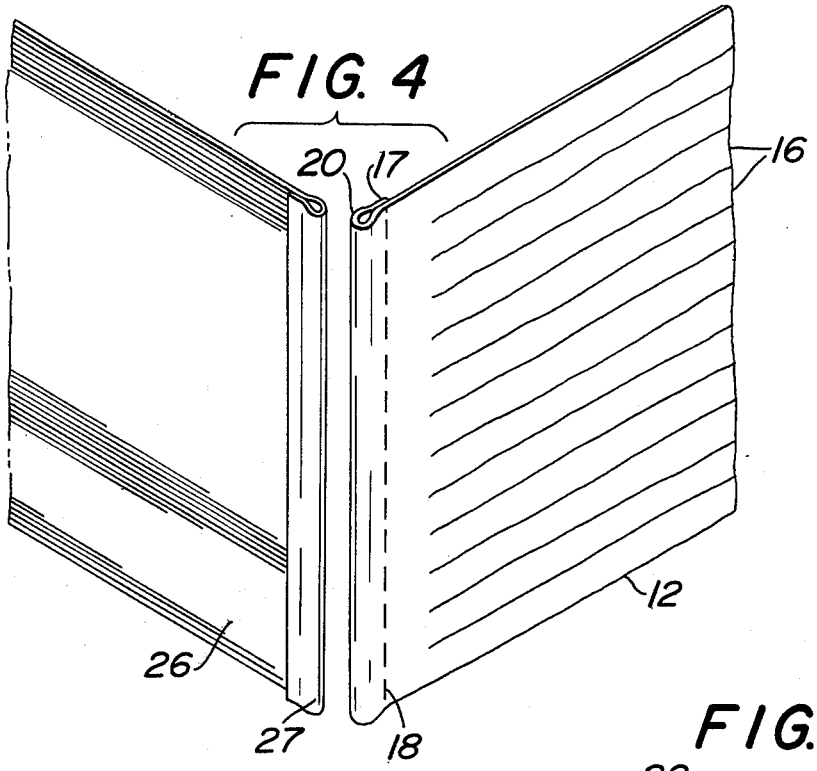
FIG. 5
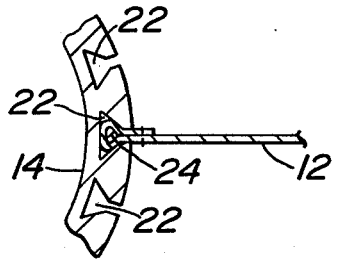
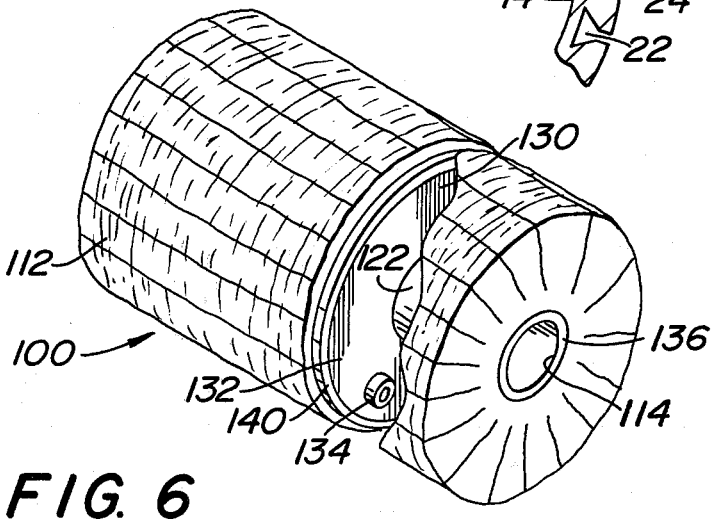
FIG. 6

VEHICLE CLEANING BRUSH HAVING LIMITED PENETRATION

BACKGROUND OF THE INVENTION

This invention relates to brushes used in conjunction with automated vehicle washing systems which permit only a limited amount of penetration into the brush of a portion of the vehicle to be washed. The brush is made almost entirely of cloth wiping members used for scrubbing and wiping the vehicle. Top brushes made entirely of cloth settle toward the vehicle surface because of the tendency of the cloth strips to wrap around the shaft or hub of the brush. This brings the hub into contact with the projecting parts of the vehicle causing damage to the vehicle or even the brush. For example, an aerial may wrap around the hub and be pulled from its mount. Bristle brushes tend to stand away from the vehicle while cleaning due to the bristles having a certain stiffness, thus not permitting the portion of the vehicle being cleaned to penetrate into the brush. However, the bristles while adequately cleaning the vehicle, tend to dull the luster and sheen of the exterior finish of the vehicle. It is known that cloth brushes do not dull the luster and shine of the exterior finish of a vehicle as do bristles. For this reason, cloth brushes have recently been put into use by car washes, especially as side brushes.

To avoid the settlement problem, top cloth brushes use a longer wiping member and therefore a considerable amount of cloth material. Typically, the cloth wiping members measure 60 inches so that the shaft or hub of the brush does not settle into contact with the vehicle. Side brushes do not settle because they rotate about a vertical axis. While the length of the cloth wiping members for top brushes tend to keep the brush shaft or hub sufficiently away from the vehicle, the cloth wiping members still tend to wrap around the hub. It is known that cloth will clean best when only a portion immediately adjacent their ends (e.g., 4 inches) comes in contact with the vehicle. A heavy mopping action is not as effective a scrubbing method as is a slap-action by contact with the distal end of the cloth wiping members of the brush. This slap-action results from the rotational motion of the brush and the interruption of that motion by contacting the vehicle. After the initial contact, which can loosen even the heaviest road dirt, the cloth wiping members provide a moderate mopping action over the vehicle surface until removed from contact by the rotation motion. Moreover, the mopping action of the cloth wiping members scrubs the vehicle surface.

The brush of the present invention is designed to overcome the deficiencies of both the cloth and the bristle type brushes currently in use. The improvement comprises a means for limiting the penetration of a portion of the vehicle being cleaned into the cloth wiping members of the brush.

Interleaved among the cloth wiping members are sets of bristles which provide support for the cloth when contacting the vehicle. The bristles prevent the problem of wraparound and also limit penetration into the brush due to their stiffness. Alternatively, a wheel-like member is used to limit penetration of vehicle parts or projections into the brush. The brush is to be used primarily in automated vehicle washing systems where a vehicle, such as an automobile, is washed by being pulled or pushed through a system of brushes, water and detergent sprays, and air dryers.

It should be noted that the brush of the present invention is designed to replace the brushes commonly in use in vehicle washing systems in any mounting configuration, thus providing even cleaning and shining over the entire vehicle.

Accordingly, it is an object of the present invention to provide a cloth vehicle scrubbing brush for cleaning the exterior of a vehicle while eliminating the problem of the cloth wiping members wrapping around the shaft or hub of the brush.

Further, it is also an object of the present invention to provide for limited penetration into the cloth wiping members of the brush of any portion of the vehicle coming into contact with the brush in order not to damage either the vehicle or the brush.

Other objects will appear hereinafter.

SUMMARY OF THE INVENTION

The present invention is directed to a rotatable cloth scrubbing brush for cleaning the exterior of a vehicle. The brush comprises a rotatable shaft or hub, cloth wiping members for contacting the surface to be cleaned, and means for limiting the penetration of the portion of the vehicle being cleaned into the cloth wiping members. Each of the cloth wiping members are connected at one end to the rotatable hub while the other end is free to contact the vehicle.

The means for limiting penetration of a portion of the vehicle being cleaned into the cloth wiping members includes at least one wheel-like member having a radius which is less than the length of the wiping members. The wheel-like member is rotatably mounted on the hub between sections of the cloth wiping members. The diameter of the wheel-like member is smaller than the diameter defined by the cloth wiping members when they are rotated. In other words, the cloth wiping members have a length such that they extend beyond the outer circumferential surface of the wheel-like member when the brush is rotated. Thus, the wheel-like member engages the surface of the vehicle and limits penetration of any portion of the vehicle being cleaned into the cloth wiping members to a depth of no more than the difference between the length of the cloth wiping members and the radius of the wheel-like member. In order to prevent damage to the vehicle being washed, specifically burnishing of the surface, the wheel-like member has applied to its outer circumferential surface a cushioning means. This cushioning means may be either additional cloth wiping members or a resilient strip of material fastened around the outer circumference of the wheel-like member.

An alternative method of limiting penetration of a portion of the vehicle being cleaned into the cloth wiping members is the use of bristles, or other suitable support material. Sets of bristles are connected to the hub and interleaved between rows of the cloth wiping members. The bristles have a length such that the cloth wiping members overlap the free ends of the bristles when they are rotated. Bristles are stiffer than cloth and therefore support the cloth wiping members holding the hub away from the vehicle surface. Thus the bristles limit penetration of the portion of the vehicle being cleaned into the cloth wiping members. Due to the difference in length of the bristles and the cloth wiping members, the bristles provide support for the cloth wiping members but do not interfere with their cleaning action.

The cloth scrubbing brush of the present invention may be used as a top brush, a side brush or a detail brush rotated about an axis which can be substantially any angle. It should be noted that to avoid free-wheeling of the wheel-like member, or disk wheel, when mounted around a horizontally arranged rotatable hub, the periphery of the disk wheel may be weighted.

For the purpose of illustrating the invention, there is shown in the drawings forms which are presently preferred; it being understood, however, that this invention is not limited to the precise arrangements and instrumentalities shown.

BRIEF DESCRIPTION OF THE DRAWINGS

FIG. 1 is a perspective view of the brush of the present invention.

FIG. 2 is a sectional view of the brush of the present invention.

FIG. 3 is a sectional view of the brush of the present invention taken along line 3—3 of FIG. 1.

FIG. 4 is a perspective view of individual cloth and bristle wiping members of the present invention.

FIG. 5 is an enlarged view of the area denoted by 5 in FIG. 3.

FIG. 6 is a perspective view of a substantially horizontally oriented brush of the present invention partially cut away to show the disk wheel for limiting penetration and the counterweight to prevent free-wheeling of the disk wheel.

DETAILED DESCRIPTION OF THE INVENTION

Figure 7:
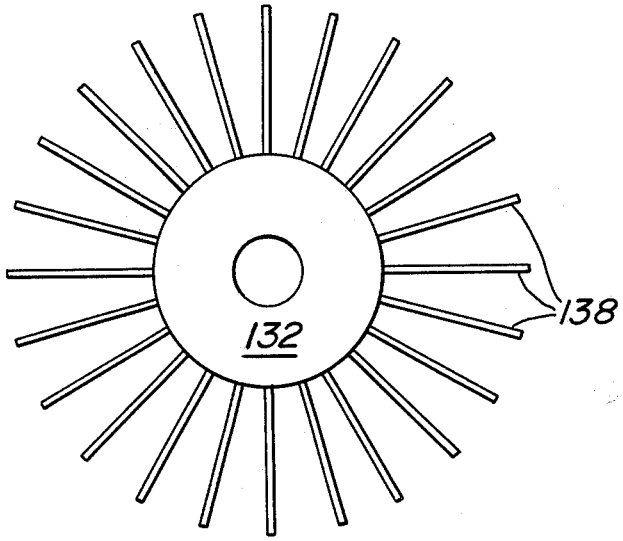
FIG. 7 is a perspective view of the disk wheel with additional cloth wiping members attached to the outer circumferential surface of the disk wheel.

Referring to the drawings in detail wherein like numerals indicate like elements, the present invention is embodied in a scrubbing brush for cleaning the exterior of a vehicle designated generally as 10. The brush 10 is comprised of separate rows of cloth wiping members 12 attached at one end to a central shaft or hub 14.

Referring to FIG. 4 an individual row of cloth wiping members 12 includes separate cloth wiping strips 16. These strips 16 may be part of the same piece of cloth and can be cut so that each strip is wider than it is thick. Each strip 16 results from the slitting of the cloth from the same end for a controlled length, or for its entire length for individual strip mounting. The widths of the strips 16 may be either equal or unequal depending upon the specific application for the cloth wiping member 12. It is preferred, but not mandatory, that the cloth wiping strips 16 are equal in width to provide uniform cleaning of the vehicle exterior.

The end 17 of the cloth is folded over and stitched along its entire length with stitches 18 to form a bight 20. The bight portion 20 of the cloth wiping members 12 is inserted into a longitudinal slot 22 in shaft or hub 14 and held in place within the slot by inserting a rod 24 through the center opening of the bight 20 as shown in FIG. 5. The slots 22 although preferably trapazoidal in cross-section may have other shapes, e.g., oval, round, etc. It is important, however, that the openings along the length of slots 22 be sufficiently narrow so as to only accomodate the thickness of the cloth wiping member 12. The narrowness of the openings of slots 22 is to retain the bight portion 20 of the cloth wiping member 12 within the slots 22 and to keep them from being pulled out by the tension caused by contact with vehicle. Although only a single cloth wiping member 12 has been described as being mounted in each slot 22, more than one cloth wiping member 12 may be mounted in a single slot 22 to provide additional contact with the vehicle by the brush.

Referring to FIG. 1, one embodiment of the present invention for limiting penetration into the brush 10 and the cloth wiping members 12 by a portion of the vehicle being cleaned comprises sets of bristles 26 interleaved between the cloth wiping members 12. Each set of bristles 26 has a shorter overall length than the cloth wiping members 12 as shown in FIG. 2. The difference in lengths between the sets of bristles 26 and the cloth wiping members 12 is preferred to be approximately two to four inches. This difference in length is directly related to the depth to which the surface of the vehicle will penetrate into the brush 10 and may be altered to provide for either a deeper or shallower penetration as required by the specific application.

As shown in FIG. 3 and described above, each of the cloth wiping members 12 is inserted into the shaft or hub 14 and secured therein by rod 24. If the brush 10 is to have sets of bristles 26 or other suitable support material to limit penetration into it, the rows of cloth wiping members 12 are inserted into the shaft or hub 14 in every other slot so that individual sets of bristles 26 may be interleaved between them. The sets of bristles 26 may be attached to a fabric base portion 28 by any known manner of attachment, e.g., sewing, etc. as shown in FIG. 4. The base 28 has a bight 27, similar to the bight 20 described in association with the cloth wiping members 12, for mounting to the shaft or hub 14 in the same manner as described above for the cloth wiping members 12. An alternate method of attaching the sets of bristles 26 (or individual cloth wiping strips 16) to the shaft or hub 14 is to crimp the bristles or strips into a channel-like member which is inserted into the slots 22 in the same manner as the cloth wiping members 12 as shown in FIG. 5. This type of attachment obviates the need for rod 24. The above examples of attaching the sets of bristles 26 are offered as examples and are not to be considered as limitations to the invention.

Referring to FIG. 2 the cloth wiping members 12 can be configured to provide for the cleaning of portions of the vehicle which are recessed behind or below the surface by increasing the length of the cloth wiping strips 16 at predetermined points to provide maximum cloth contact with the vehicle. On the right side of FIG. 2, in which the brush 10 is oriented about a vertical rotational axis, the cloth wiping strips are lengthened at the bottom of the cloth wiping member 12 to provide for cleaning of the vehicle rocker panels and wheels. If the brush 10 were oriented in a substantially horizontal rotational axis with the lengthened cloth wiping strip 16 along the outside of the brush 10 with regard to the vehicle, the extended cloth wiping strips 16 will extend over and down the side of the vehicle to provide a scrubbing and wiping action along that portion of the vehicle. With regard to the left side of FIG. 2, the relationship between the cloth wiping members 12 and the sets of bristles 26 can be readily observed. As the brush 10 rotates the cloth wiping members 12 will overlap the free ends of the sets of bristles 26 so that the bristles 26 provide support for the cloth wiping members 12 and also limit the penetration of any portion of the vehicle into the brush. Moreover, in uneven areas of the surface of the vehicle such as the bumper and grill area, the sets of bristles 26 will also be effective in cleaning as well as supporting the cloth wiping member 12. To prevent any of the cloth wiping members 12 or sets of bristles 26 from becoming detached from or sliding out of the shaft or hub 14 an end or covering piece 36 is attached to both ends of the hub 14. The piece 36 can be attached in any manner known in the mechanical arts to prevent the cloth wiping members 12 and sets of bristles 26 from sliding out of slots 22 and becoming detached during rotation of the brush 10.

Referring now to FIG. 6 a second embodiment of the brush 10 is shown. The brush 100 is oriented about a substantially horizontal rotational axis for use as a top brush. The cloth wiping members 112 are mounted to the shaft or hub 114 in the same manner as described above and shown in FIG. 5. However, the cloth wiping members 112 may be mounted in sections along the length of the shaft or hub 114 for easier managability in replacing the members 112 either during routine maintenance or otherwise.

As the brush 100 is rotated about its horizontal rotational axis the free ends of the cloth wiping members 112 define a diameter for said brush. In order to limit the penetration into the brush of a portion of the vehicle being cleaned a wheel-like member or disk wheel 130 is interposed between sections of the cloth wiping members 112. The disk wheel 130 is mounted around the shaft or hub 114 using any manner known in the mechanical arts so that the disk wheel 130 can rotate with respect to the shaft or hub. The disk wheel 130 has a radius such that the cloth wiping members 112 extend beyond the outer circumferential surface of the disk wheel. Thus the disk wheel 130 limits the penetration of any portion of the vehicle being cleaned into the cloth wiping members 112 of the brush 100 to a depth of no more than the difference between the length of the cloth wiping members 112 and the radius of the disk wheel 130. This distance is preferred to be five to six inches but may be varied according to the specific application or use of the brush.

In order to prevent any damage to the vehicle being cleaned, specifically burnishing of the surface, the disk wheel 130 has applied to its outer circumferential surface a cushioning means 132. The cushioning means 132 can be any material which is resilient and will not scratch the surface of the vehicle when coming into contact with it, e.g. vinyl, certain plastic resins, etc. Th cushioning means 132 may include additional cloth wiping members 138 attached to the outer circumference of the disk wheel 130 by any suitable means known in the mechanical arts as shown in FIG. 7. The cloth wiping members 138 attached to the disk wheel 130 will provide a more uniform cleaning of the vehicle surface. There will no longer be a gap between sections of the cloth wiping members 112 due to the disk wheel 130 which may have caused the adjacent portion of the vehicle being washed to go unscrubbed. The clothing wiping members 138 will provide a cleaning and wiping action similar to the other cloth wiping member 112 of the brush 100 until the vehicle penetrates into the brush 100 to contact the disk wheel 130. The cloth wiping members 138 will then act as the cushioning means 132 and the disk wheel 130 will no longer free-wheel with the shaft or hub 114 but roll along the vehicle surface preventing the vehicle from penetrating further into the brush 100. Alternatively, the cushioning means 132 may be a resilient strip of material 140 attached to the outer circumference of the disk wheel 130 in a manner similar to the one discussed immediately above.

To prevent free-wheeling of the disk wheel 130 with respect to the shaft or hub 114, a counterweight 134 may be used. The counterweight can be disposed either along the outer periphery or made part of the disk wheel 130. The attaching of the counterweight 134 to the disk wheel 130 can be done in any known manner such as by inserting at least one bolt through the counterweight and the disk wheel and securing the other end of the bolt by use of a nut. It should be noted that to prevent any of the cloth wiping members 112 from becoming detached from the shaft or hub 114 an end or covering piece 136 is attached to both ends of the shaft or hub 114 in any manner known in the mechanical arts to prevent the cloth wiping members 112 from sliding out of the slots 122 and becoming detached during rotation of the brush 100.

In using any of the brushes described above, both water and water/soap mixture can be core-fed from the shaft or hub 14, 114 through holes in said shaft or hub and along the cloth wiping members 12, 112 and sets of the bristles 26 to the surface of the vehicle being cleaned. This method of water and water/soap mixture distribution through the shaft or hub 14, 114 provides for more even dispersion over the vehicle surface. The liquids can be supplied to the shaft or hub 14, 114 in any manner known to the mechanical arts. The holes in the shaft or hub 14, 114 can be any arrangement so as to provide for an even dispersion of the liquids.

The brush of the present invention provides a cloth wiping surface to scrub and shine the exterior of a vehicle which is being washed while limiting penetration of the surface of that vehicle into the brush. The limited penetration will negate damage to either the brush or the vehicle which comes into contact with it. In addition, the cloth brush provides an even, consistent cleaning and shining over the entire surface of the vehicle due to the use of cloth wiping members.

The present invention may be embodied in other specific forms without departing from the spirit or essential attributes thereof and, accordingly, reference should be made to the appended claims, rather than to the foregoing specification, as indicating the scope of the invention.

I claim:

1. A rotatable cloth scrubbing brush for cleaning the exterior of a vehicle comprising:

a. a rotatable shaft of hub;

b. a plurality of cloth wiping members for contacting the surface to be cleaned, said cloth wiping members being connected at one end to said rotatable shaft or hub; and c. a plurality of bristle members having a shorter overall length than said cloth wiping members said bristle members being interleaved between rows of said cloth wiping members and being connected at one end to said rotatable shaft or hub, so that said cloth wiping members overlap free ends of said bristle members when said shaft or hub is rotated whereby said bristle members support said cloth wiping members as said cloth wiping members overlap said bristle members and said bristle members limit the penetration of said cloth wiping members into that portion of the vehicle being cleaned.

2. The rotatable cloth scrubbing brush according to claim 1 wherein the difference in length between said cloth wiping members and said bristle members is two to four inches.

3. The rotatable cloth scrubbing brush according to claim 1 wherein the difference in length between said cloth wiping members and said bristle members is alterable to adjust the amount of penetration of said cloth wiping members into said vehicle.

* * * * *